US012298095B2

(12) United States Patent
Ray

(10) Patent No.: US 12,298,095 B2
(45) Date of Patent: May 13, 2025

(54) FIREARM SAFETY DEVICE

(71) Applicant: Craig Dwayne Ray, Raleigh, NC (US)

(72) Inventor: Craig Dwayne Ray, Raleigh, NC (US)

(73) Assignee: C&M Simple Solutions, LLC, Wilmington, NC (US)

( * ) Notice: Subject to any disclaimer, the term of this patent is extended or adjusted under 35 U.S.C. 154(b) by 0 days.

(21) Appl. No.: 18/228,945

(22) Filed: Aug. 1, 2023

(65) Prior Publication Data

US 2025/0044048 A1 Feb. 6, 2025

(51) Int. Cl.
*F41A 17/44* (2006.01)
*F41A 17/74* (2006.01)

(52) U.S. Cl.
CPC ..... *F41A 17/74* (2013.01); *F41A 17/44* (2013.01)

(58) Field of Classification Search
CPC .... F41A 17/44; F16B 2/22; F16B 2/24; F16B 2/241; F16B 2/243; F16B 2/245
See application file for complete search history.

(56) References Cited

U.S. PATENT DOCUMENTS 614,019 A * 11/1898 Mattson ..... F41C 9/08 42/83
773,979 A * 11/1904 Pevey ..... D06F 55/00 24/556
2,172,302 A * 9/1939 Tinnerman ..... F16B 2/245 24/581.1
2,318,853 A * 3/1943 Hall ..... F16B 5/0685 248/74.2
2,960,742 A * 11/1960 Solomon ..... A44B 99/00 24/561
3,119,163 A * 1/1964 Merfeld ..... A44B 6/00 D28/39
3,298,073 A * 1/1967 Merfeld ..... A44B 99/00 24/555
3,754,307 A * 8/1973 Froehlich, Jr. ..... A44B 99/00 24/555
3,762,089 A * 10/1973 Meyer, Jr. ..... F41A 17/74 42/106
3,766,613 A * 10/1973 Merfeld ..... A44B 99/00 24/561
3,924,512 A * 12/1975 Fagg ..... F41A 19/33 89/142
5,183,959 A * 2/1993 McCoan ..... F41A 17/00 89/146

(Continued)

FOREIGN PATENT DOCUMENTS

WO WO-2023028351 A2 * 3/2023

*Primary Examiner* — Gabriel J. Klein
(74) *Attorney, Agent, or Firm* — Murphy, Bilak & Homiller, PLLC

(57) ABSTRACT

A firearm safety device includes a clip including a bend between a first end and a second end, wherein the clip is configured to mate with a firearm that comprises an accessible safety selector rod, and thereby place the firearm in a safety-locked position, wherein a section of the clip that extends to the first end is configured to be inserted into a gap of the firearm behind the safety selector rod and thereby prevent rotation of the safety selector rod in the safety-locked position., and wherein a section of the clip that extends to the second end is configured to be retained against an opposing surface of the firearm in the safety-locked position.

17 Claims, 8 Drawing Sheets

(56) References Cited

U.S. PATENT DOCUMENTS

| | | | | | |
|---|---|---|---|---|---|
| 5,680,724 | A * | 10/1997 | Peterken | F41A 17/44 | 42/70.11 |
| 6,457,218 | B1 * | 10/2002 | Lawrence | B42F 1/10 | 24/3.12 |
| D492,351 | S * | 6/2004 | Sato | D19/86 | |
| D623,048 | S * | 9/2010 | Moy | G09F 23/00 | D8/395 |
| 7,963,010 | B2 * | 6/2011 | Levesque | A44B 99/00 | 24/561 |
| 9,328,980 | B1 * | 5/2016 | Doto | F41A 35/00 | |
| D912,972 | S * | 3/2021 | Gunaratne | D3/215 | |
| D982,425 | S * | 4/2023 | Foral | D8/382 | |
| 2007/0273520 | A1 * | 11/2007 | Chamandy | G06K 19/07749 | 340/572.1 |
| 2010/0078101 | A1 * | 4/2010 | Styron | A45C 1/06 | 150/147 |
| 2013/0111796 | A1 * | 5/2013 | Dionne | F41A 17/00 | 42/70.11 |
| 2015/0089854 | A1 * | 4/2015 | Findlay | F41A 3/38 | 42/20 |
| 2015/0168090 | A1 * | 6/2015 | Bitsack | F41A 17/44 | 42/70.01 |
| 2016/0097413 | A1 * | 4/2016 | Sumners | F16L 3/1233 | 24/561 |
| 2016/0187089 | A1 * | 6/2016 | Wengender | F41A 17/74 | 42/70.04 |
| 2017/0307320 | A1 * | 10/2017 | Bailey | F41A 17/74 | |
| 2021/0148666 | A1 * | 5/2021 | Schmid | F41A 19/46 | |
| 2023/0094122 | A1 * | 3/2023 | DeVoe | F41A 33/00 | 29/428 |

* cited by examiner

FIREARM SAFETY DEVICE

BACKGROUND

Many Americans own at least one firearm. According to estimates by the United States Bureau of Alcohol, Tobacco and Firearms and Explosives (ATF), approximately 465 million firearms were produced for the U.S. market between the years of 1899 and 2021. While the exact number of firearms currently in circulation in the United States is unknown, conservative estimates place the number in the range of at least 300 million firearms. Firearms by nature are dangerous items. According to estimates by the United States Center for Disease Control, approximately 500 Americans per year die from accidental firearm shootings, and approximately 27,000 Americans suffer some form of injury from accidental firearm shootings.

Many owners of firearms take steps to safely store and secure their firearms to mitigate the possibility that the firearm is accidentally fired, either by the owner or another party that comes into possession of the weapon, such as a child. These steps may also be used to prevent an intruder from accessing the weapon and potentially firing it intentionally. However, current solutions for safely storing and securing firearms have drawbacks. For example, these solutions add time-consuming barriers to make the firearm ready to fire, which may be detrimental in the case of an emergency. Moreover, these solutions are conspicuous and hence can be defeated, e.g., by finding a key or cutting a cable.

SUMMARY

A firearm safety device is disclosed. According to an embodiment, the firearm safety device comprises a clip comprising a bend between a first end and a second end, wherein the clip is configured to mate with a firearm that comprises an accessible safety selector rod, and thereby place the place the firearm in a safety-locked position, wherein a section of the clip that extends to the first end is configured to be inserted into a gap of the firearm adjacent to the safety selector rod and thereby prevent rotation of the safety selector rod in the safety-locked position, and wherein a section of the clip that extends to the second end is configured to be retained against an opposing surface of the firearm in the safety-locked position.

A method of securing a firearm is disclosed. According to an embodiment, the method comprises providing a firearm that comprises an accessible safety selector rod, providing a clip comprising a bend between a first end and a second end, and mating the clip with the firearm such that the firearm is in a safety-locked position, wherein the mating of the clip with the firearm comprises inserting a section of the clip that extends to the first end into a gap of the firearm behind the safety selector rod, thereby preventing rotation of the safety selector rod, and securely retaining a section of the clip that extends to the second end against an opposing surface of the firearm.

BRIEF DESCRIPTION OF THE DRAWINGS

FIG. 1, which includes FIG. 1A depicts the clip from an isometric perspective; FIG. 1B depicts the clip from a side-view perspective; and FIG. 1C depicts the clip from a front-view perspective.

FIG. 2, which includes FIG. 2A depicts the clip and firearm from an isometric perspective with interior components of the firearm's lower receiver being visible, FIG. 2B depicts the clip and firearm from a side-view perspective with interior components of the firearm's lower receiver being visible, and FIG. 2C depicts the clip and firearm from a side-view perspective.

FIG. 3, which includes FIG. 3A depicts the firearm with the internal housing exposed such that a gap behind the safety selector rod is accessible; FIG. 3B depicts the firearm upon insertion of a first end of the clip into the gap behind the safety selector rod; and FIG. 3C depicts the firearm after a section of the clip that extends to a second end is secured against an opposing surface of the firearm.

DETAILED DESCRIPTION

Embodiments of a clip for safely securing a firearm and a corresponding method for safely securing a firearm using the clip are disclosed herein. The clip is configured to be mated with a firearm in such a way that the clip places the firearm in a safety-locked position, meaning that the firearm's existing safety mechanism is forced to remain in the "on" or "safe" position and the firearm cannot be fired. The clip is geometrically configured such that a first section of the clip can be inserted into a gap behind a safety selector rod of the firearm, thereby forming a blocking device that prevents rotation of the safety selector rod. Additionally, the clip is configured such that a second section of the clip can be retained against an opposing surface of the firearm, i.e., a surface which opposes the clip, thereby keeping the clip securely in place. Embodiments of the clip disclosed herein are compatible with any firearm that comprises an accessible safety selector rod and a opposing surface from which to secure the clip. A single form factor of the clip may be compatible with many types of firearms that share common traits. For example, a particular clip design is disclosed herein that is compatible with most variants of the widely popular AR-15 style class of firearms. The clip provides a simple and cost-effective solution for safely securing a firearm and preventing unwanted parties from accidentally or intentionally firing the weapon. Due to its size and location, the clip may be concealed within the firearm and hence be inconspicuous. A party that is unaware that the clip is installed within the firearm may be unable to fire the weapon and, importantly, unable to understand why the weapon will not fire. Meanwhile, the owner of the weapon that is aware of the presence of the clip can quickly and easily remove it, even in the dark, if necessary.

Figure 1A:
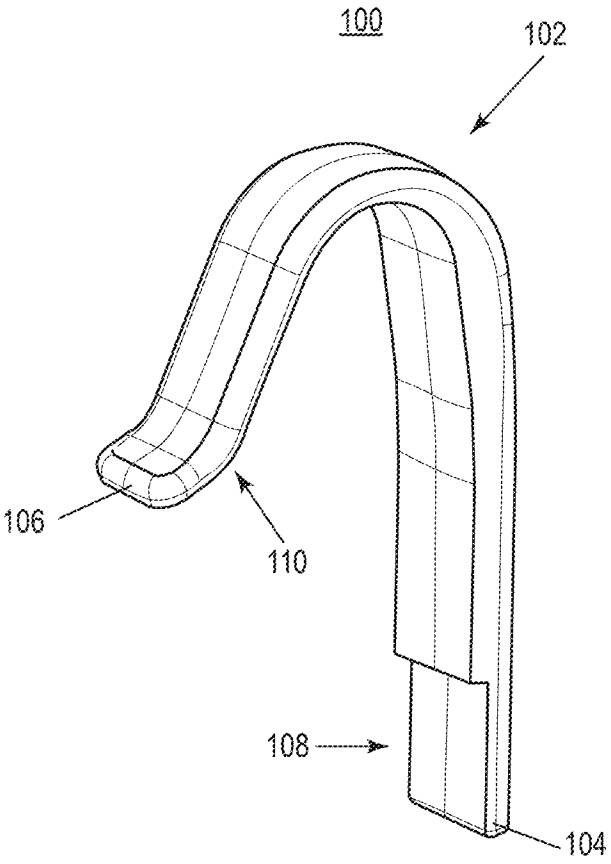
FIGS. 1A, 1B, and 1C, depicts a clip, according to an embodiment.
Figure 1C:
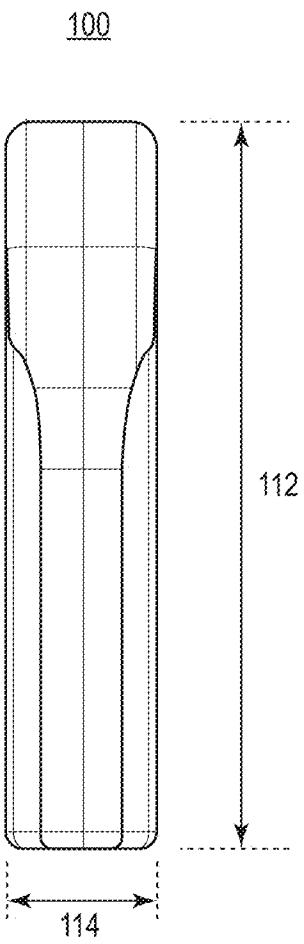
Figure 1B:
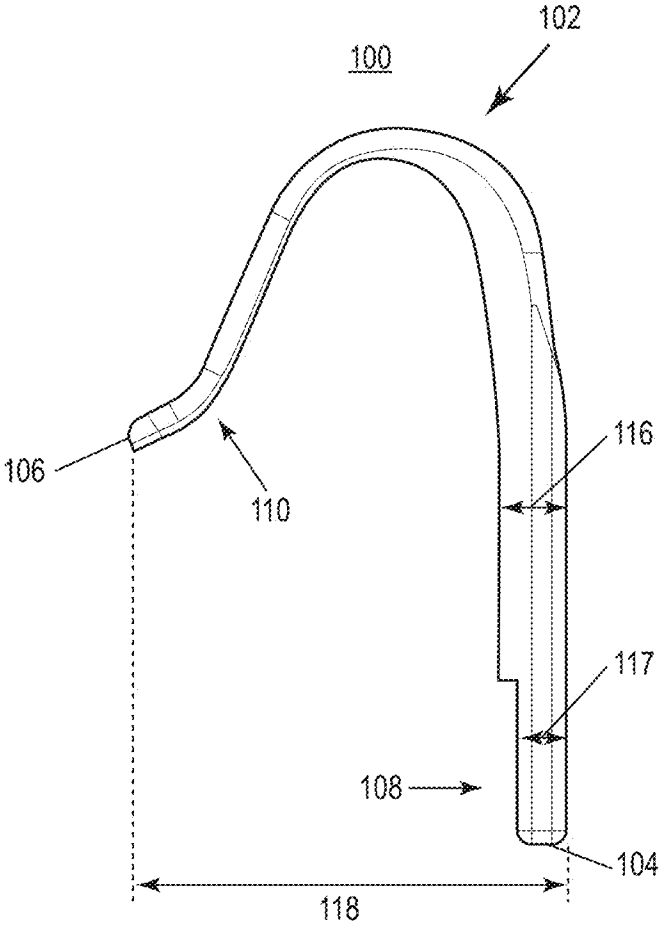

Referring to FIG. 1, a clip 100 is shown, according to an embodiment. The clip 100 comprises a bend 102 between a first end 104 and a second end 106. The bend 102 refers to a redirection in the direction of extension of the clip 100. The clip 100 comprises a section that extends to the first end 104 and a section that extends to the second end 106. These sections refer to the parts of the clip 100 on either side of the bend 102. These sections may be planar or substantially planar or, as shown, may comprise further geometric refinements. As shown, the bend 102 may have a curved shape. In other embodiments, the bend 102 may be formed by an acute transition between two linearly extending sections of the clip 100, e.g., a V-shape.

According to an embodiment, the clip 100 is elastically compressible about the bend 102. This means that the clip 100 can be manipulated by ordinary (human) manual force to bring opposite facing spans of the clip 100 on either side of the bend 102 close to one another. That is, the clip 100 is designed to be pinched together and then released to retain its original shape. According to a more particular embodiment, the clip 100 is completely elastically compressible about the bend 102 such that opposite facing spans of the clip 100 on either side of the bend may be brought into contact with one another without breaking or deforming the clip 100.

According to an embodiment, an outermost part 108 of the clip 100 that extends to the first end 104 has a locally reduced cross-sectional area in comparison to the remaining section of the clip 100 that extends towards the first end 104. As shown, the clip 100 may have an abrupt, step-shaped transition between the outermost part 108 and the adjoining section of the clip 100. Other more gradual transitions are possible. This optional tapering of the clip 100 as it approaches the first end 104 may make the clip 100 particularly compatible with certain firearm designs wherein a gap adjacent to the safety selector rod narrows. In other embodiments, this feature may be omitted such that the cross-sectional profile of the clip 100 remains constant or substantially constant as it approaches the first end 104 of the clip 100. The clip 100 may optionally include a locally widened region (not shown), e.g., a bump, in a central section between the bend 102 and the first end 104. In this locally widened region, the cross-sectional thickness of the clip 100 may increase, e.g., by a factor of 1.5 to 2.5. This locally widened region may act as a bend limiting feature to prevent full flexing of the clip 100.

According to an embodiment, the section of the clip 100 that extends to the second end 106 comprises a second bend 110 that curves in an opposite direction as the bend 102. That is, the clip 100 may be configured to bend outward as it approaches the second end 106. This redirection of the clip 100 may create a retention feature that allows the clip 100 to be secured against an opposing surface of a firearm, an example of which will be shown and discussed below. Other designs are possible. For example, the second bend 110 may be omitted such that the clip 100 extends along the same plane as it approaches the second end 106 of the clip 100. In still other examples, the clip 100 may include additional bends or bends in either direction as it approaches the second end 106. These geometries may be adapted to make the clip 100 compatible with a particular opposing surface geometry.

The material composition of the clip 100 may be selected based on a variety of considerations. These considerations include mechanical strength, compressibility, and elasticity of the clip 100. For example, the material which forms the clip 100 may be selected such that the clip 100 can be elastically compressed about the bend 102 and retain its original shape after being released multiple times, e.g., over the useful life of the product. Separately or in combination, the material of the clip 100 may be selected to have sufficient hardness (e.g., as measured by so-called Vickers hardness) such that the clip 100 can withstand the twisting force applied to a safety selector switch of a weapon in the manner to be described below. Separately or in combination, the material of the clip 100 may be selected such that the clip 100 has a smooth and hard texture, and has sufficient resistance to at least trace amounts of cleaning solutions commonly applied to firearms, such as such as heptane, acetone, methanol, carbon dioxide, and toluene, etc. Separately or in combination, the material of the clip 100 may be selected such that the clip 100 may withstand temperature extremes ranging from −40 degrees Celsius to 60 degrees Celsius, which may periodically be encountered by the clip 100 over its useful lifetime. Exemplary materials for the clip 100 that meet these criteria include a wide variety of plastic materials, including thermoplastic materials such as polyoxymethylene, plyetheretherketone, nylon, etc. and compositions thereof, and metals such as aluminum, steel, nickel, etc. and alloys thereof.

In general, the dimensions of the clip 100 may be selected based upon a variety of factors. These factors include compatibility with a particular firearm or group of firearms, required mechanical properties, e.g., compressibility, mechanical strength, manufacturability, etc. The following dimensions represent exemplary values for a clip 100 that is designed to be compatible with an AR-15 style firearm, meaning that the clip 100 can mate with the AR-15 style firearm and place the AR-15 style firearm in a safety-locked position as will be described in further detail below. The clip 100 may have a maximum height displacement 112 of between 35 mm and 40 mm, a maximum width 114 of between 7 mm and 8 mm, a thickness 116 of between 3 mm and 4 mm in a central section, a thickness 117 in the outermost part 108 of between 2 mm and 3 mm, a total length 118 of between 22 mm and 24 mm, a radius of the bend 102 of between 4.00 mm and 8.00 mm, an angular difference between the section of the clip 100 that extends to the first end 104 and the interior section of the clip 100 that extends towards the second end 106 of between 20° and 25°, and an angular difference between the interior section of the clip 100 that extends toward the second end 106 and the outer section of the clip that reaches the second end 106, i.e., the portions of the clip 100 on either side of the second bend 110, of between 30° and 50.° In one particular embodiment, the clip 100 may have a maximum height displacement 112 of about 38.0 mm, a maximum width 114 of about 7.6 mm, a thickness 116 of about 3.55 mm, a thickness 117 in the outermost part 108 of about 2.5 mm, a total length 118 of about 23.0 mm, a radius of the bend 102 that varies between 4.75 mm and 7.45 mm, an angular difference between the section of the clip 100 that extends to the first end 104 and the section of the clip 100 that extends towards the second end 106 of between 23.5° and 25°, and an angular difference between the interior section of the clip 100 that extends towards the second end 106 and the outer section of the clip that reaches the second end 106, i.e., the portions of the clip 100 on either side of the second bend 110, of between 40.° More generally, the dimensions of the clip 100 can vary from the values disclosed above and the proportional relations of the features of the clip 100 can vary from what is shown in the drawings. For example, the clip 100 may be adapted to different firearm or class of firearms than an AR-15 style firearm. Generally speaking, a maximum height of a clip may be between about 10 mm and 100 mm, a thickness of a clip may be between about 1 mm and 10 mm, and a width of a clip may be between about 2 mm and 20 mm. The number of bends and/or radius of bends and/or angling of the various sections of a particular clip may be selected based upon factors including the necessary elasticity of the clip and/or the amount of space provided by the firearm or firearms to which the clip is designed to be used with.

Figure 2A:
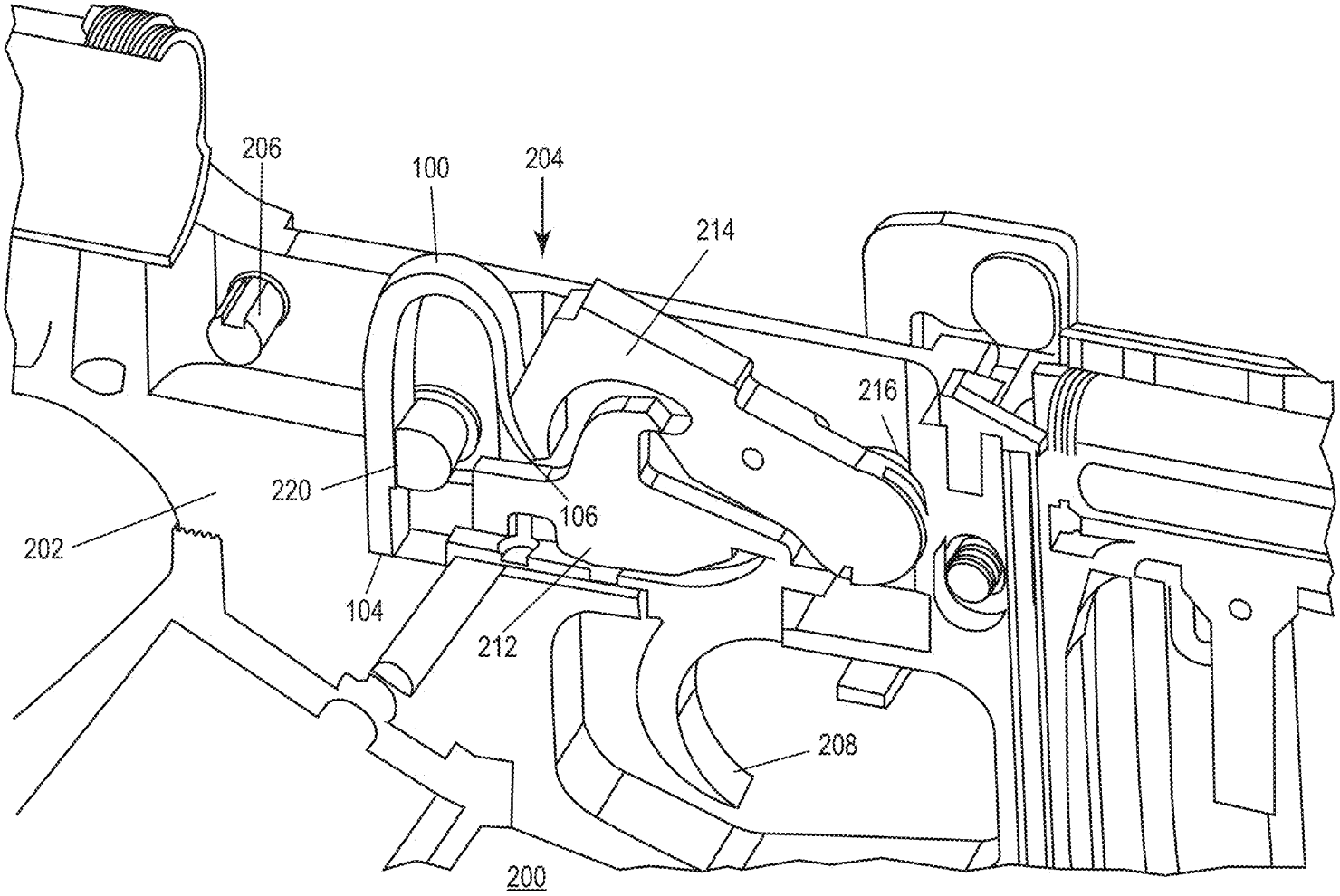
FIGS. 2A, 2B, and 2C depicts different views of the clip mated with a firearm such that the firearm is in a safety-locked position, according to an embodiment.
Figure 2B:
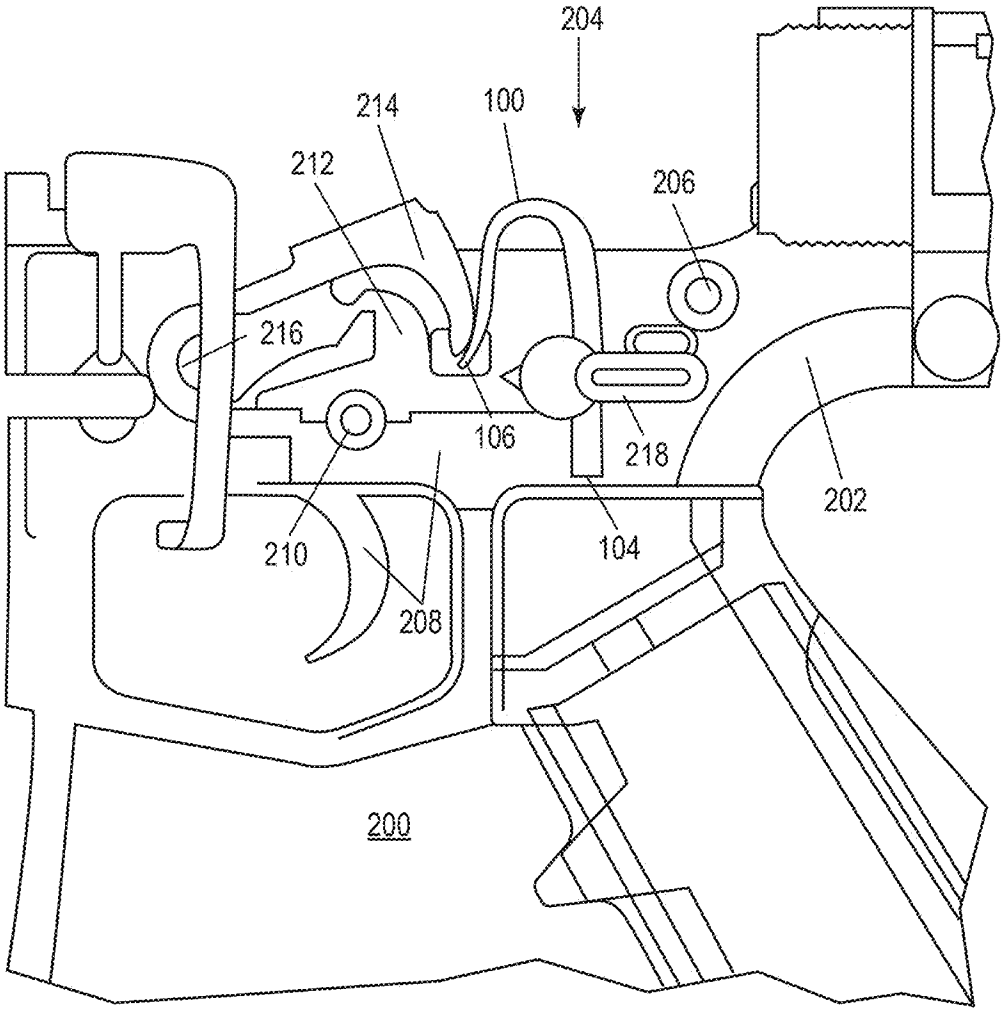
Figure 2C:
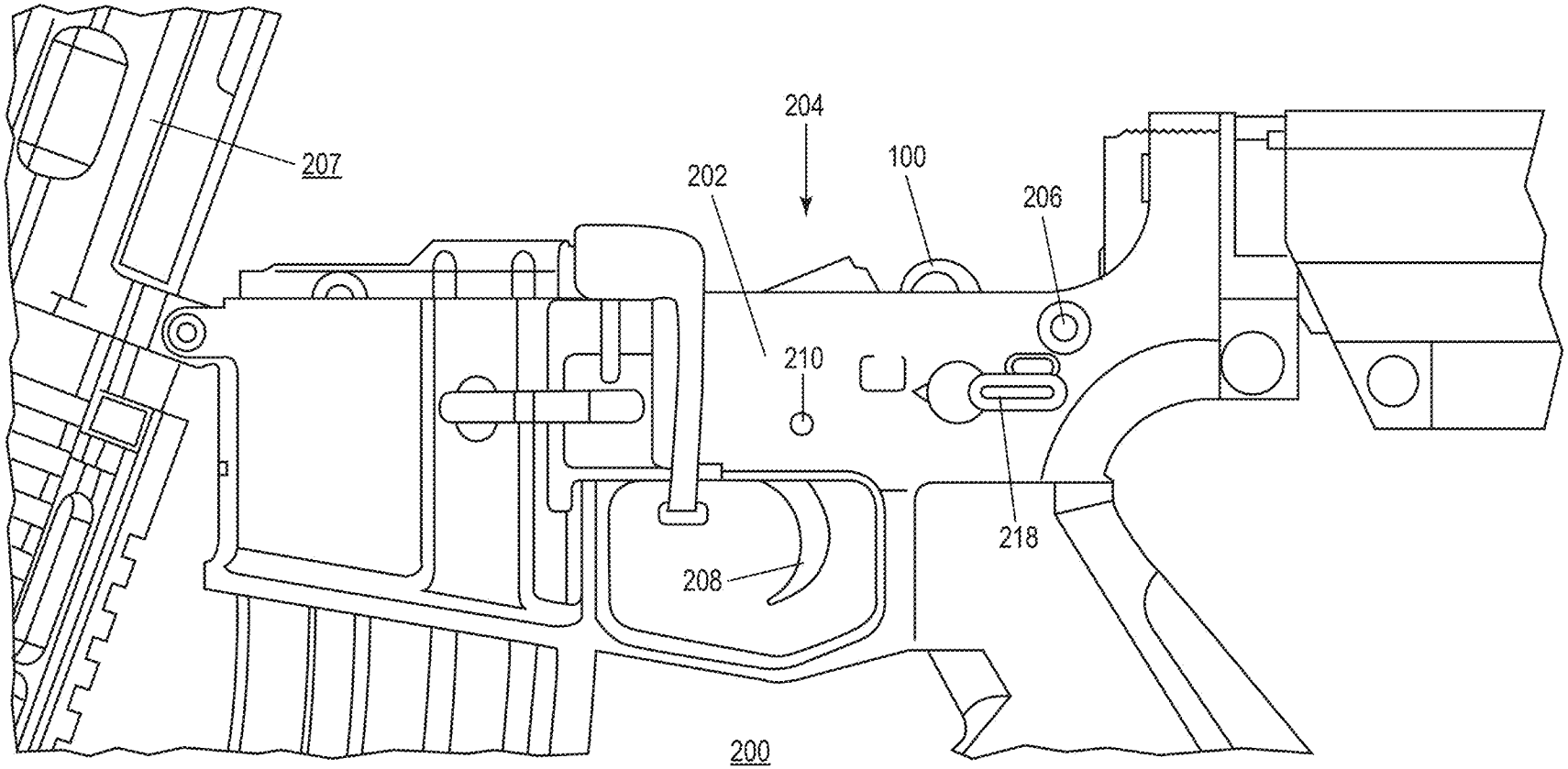

Referring to FIG. 2, the clip 100 is shown after mating the clip 100 with a firearm 200. The depicted firearm 200 is a particular example of a so-called AR-15 style firearm. The term "AR-15" traces its origin to the ArmaLite AR-15, which was manufactured by the ArmaLite corporation in the late 1950's and early 1960's. The Colt corporation, another firearm 200 manufacturer, bought the rights to the AR-15 design from ArmaLite, and currently owns the trademark rights to the term "AR-15." The Colt corporation currently sells a class of semi-automatic rifles for civilian use under the name "AR-15." The term "AR-15 style firearm" refers to a broad class of semi-automatic rifles that are sold for civilian use by many different manufacturers. These weapons share many similar characteristics with the Colt AR-15 design, and have a standard modular platform that can be fitted with adaptable components, e.g., grip, stock, telescope, etc. The particular embodiment of the clip 100 shown in the drawings and having the dimensions discussed in the preceding paragraph is designed to be compatible with most of the AR-15 style firearms currently manufactured. This is due to the standardized dimensioning and function of the components of AR-15 style firearms, and in particular those components within the lower receiver 202 of the firearm 200. The below description refers to the pertinent components of an AR-15 style firearm to the extent necessary to disclose the features of the clip 100 and the interaction between the clip 100 and the firearm 200. The structure and function of the remaining components of an AR-15 style firearm are well-known to those having ordinary skill and therefore not specifically discussed.

The firearm 200 comprises a lower receiver 202 that contains the main functional components responsible for firing the weapon. These components include a trigger assembly, and a safety mechanism, each of which are arranged within an exposable internal housing 204 of the firearm 200. This internal housing 204 may be accessed via takedown pins 206 that separate an upper receiver 207 of the firearm 200 from the lower receiver 202, thereby exposing the trigger assembly and the safety mechanism from above.

The trigger assembly comprises a trigger 208, a trigger pin 210, a sear 212, a hammer 214, and a hammer spring 216. The firing sequence of the firearm 200 is initiated when the safety mechanism is in the safety-off position and the exposed part of the trigger 208 is pulled back. This causes the trigger 208 to rotate about the trigger pin 210, thereby releasing the hammer 214 from the cocked position. Consequently, the hammer 214 rotates due to a twisting force applied by the hammer spring 216. The hammer 214 then strikes a firing pin (not shown), which in turn strikes a cartridge and thereby initiates an explosion that propels a bullet out from the cartridge.

The safety mechanism comprises a safety selector switch 218 and a safety selector rod 220. The safety selector rod 220 runs transverse to the movement direction of the trigger 208 and is disposed behind a rear portion of the trigger 208. From a cross-sectional perspective, the safety selector rod 220 has a rounded side and a flat side. For example, the safety selector rod 220 may have a D-shaped cross section, e.g., as shown in FIG. 2A. The safety selector switch 218 can be toggled between the safety-off position wherein the safety selector switch 218 points toward the "fire" label in the depicted firearm 200 and the safety-on position wherein the safety selector switch 218 points toward the "safe" label in the depicted firearm 200. The particular label of the various safety states may vary between firearms, including between various versions of the AR-15. The toggling of the safety selector switch 218 rotates the safety selector rod 220 to control the safety function. In the safety-off position, the flat side of the safety selector rod 220 faces downward and a gap exists between the rear portion of the trigger 208 and the safety selector rod 220, thereby permitting the trigger 208 to rotate about the trigger pin 210. In the safety-on position, the rounded side of the safety selector rod 220 faces the rear portion of the trigger 208 (as shown) and eliminates this gap, thereby preventing the trigger 208 from rotating about the trigger pin 210. In the safety-on position, there is a gap between the flat side of the safety selector rod 220 and a rear wall of the firearm 200. This gap provides clearance for the safety selector rod 220 to be rotated between the safety-off position and the safety-on position.

In FIG. 2, the clip 100 has been mated with the firearm 200 to place the firearm in a safety-locked position whereby the safety mechanism is forced to remain in the safety-on position and the firearm cannot be fire. In the safety-locked position, a section of the clip 100 that extends to the first end 104 is arranged within the gap of the firearm 200 that is behind the safety selector rod 220. This section of the clip 100 acts as a wedge that is flush against the flat surface of the safety selector rod 220 from behind the safety selector rod 220 and prevents the safety selector rod 220 from being rotated. The section of the clip 100 that extends to the first end 104 may be dimensioned in a corresponding manner as the geometry of the gap behind the safety selector rod 220 of the firearm 200. In this way, the clip 100 creates a blocking device fit that prevents rotation of the safety selector rod 220. Moreover, the section of the clip 100 that extends to the first end 104 may be dimensioned with for maximum compatibility with different variations of the firearm 200, e.g., by maintaining cross-sectional width below minimum values seen in any variant of the firearm 200. In weapons with smaller sized gaps, the fit of the clip 100 may be relatively snug. In weapons with larger sized gaps, there may be a degree of clearance between the section of the clip 100 that extends to the first end 104 and the safety selector rod 220. In any case, the safety selector rod 220 is blocked from rotating. As mentioned above, an outermost part 108 of the section of the clip 100 that extends to the first end 104 hay have locally reduced cross-sectional area. This outermost part 108 may fit into a correspondingly shaped gap that is below the safety selector rod 220 that is present in some versions of the AR-15 style rifle, thus providing insert compatibility.

In the safety-locked position, the section of the clip 100 that extends to the second end 106 is retained against the hammer 214 of the firearm 200. This prevents the clip 100 from easily falling out of the gap of the firearm 200 that is behind the safety selector rod 220, e.g., when the firearm 200 is turned upside down. The clip 100 may be in a compressed state when secured such that the section of the clip 100 that extends to the second end 106 presses against the hammer 214. Moreover, additional retention of the clip 100 may result from the shape and engagement of the features. As shown, the hammer 214 of the firearm 200 comprises an outer surface that is angled towards a rear of the firearm 200 when the hammer 214 is in a cocked position. The clip is configured such that the section of the clip 100 that extends to the second end 106 is oriented substantially parallel to this outer surface of the hammer 214 of the firearm 200 when the clip 100, thereby keeping the clip 100 securely in place underneath the hammer 214. A proper mating of the surfaces can be obtained through appropriate selection of the location and radius of the bend 102, the second bend 110, and the angular difference between the interior section of the clip 100 that extends towards the second end 106 and the outer section of the clip that reaches the second end 106. Stated another way, the second bend 110 may be configured to provide the appropriate engagement with a lower tip of the hammer 214 and provide a tight fit with the clip 100.

Figure 3A:
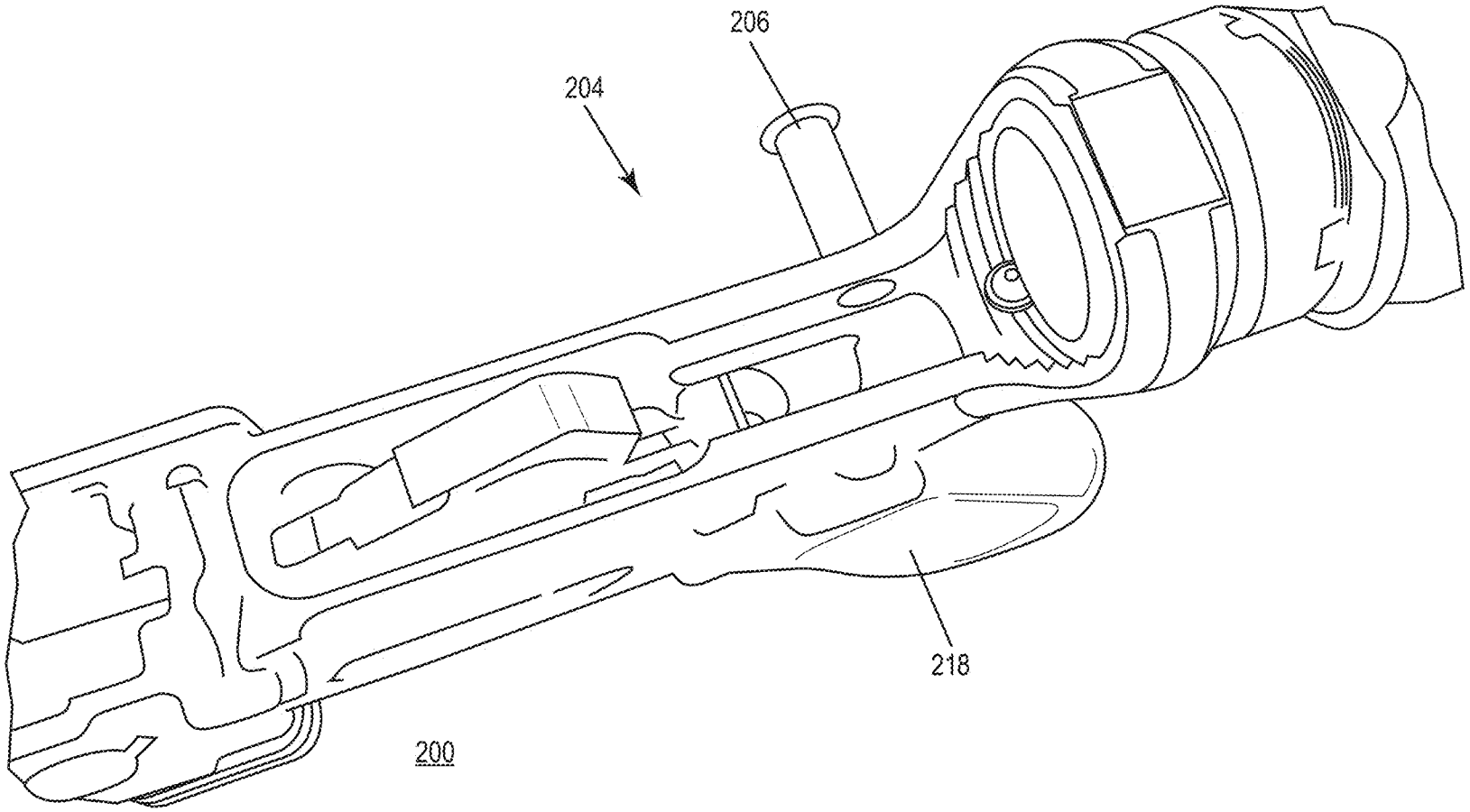
FIGS. 3A, 3B, and 3C depicts selected steps in a method for securing a firearm, according to an embodiment.
Figure 3B:
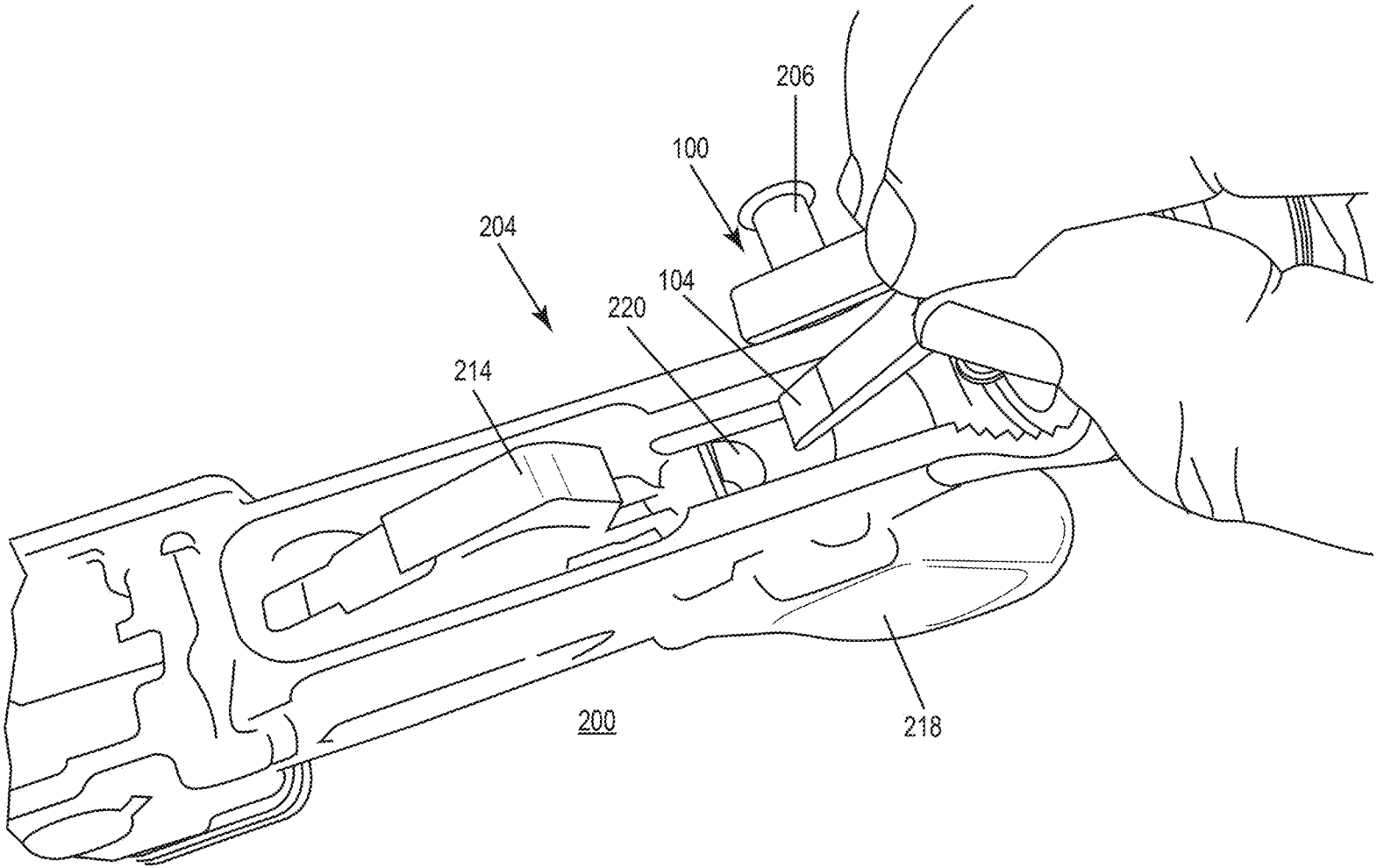
Figure 3C:
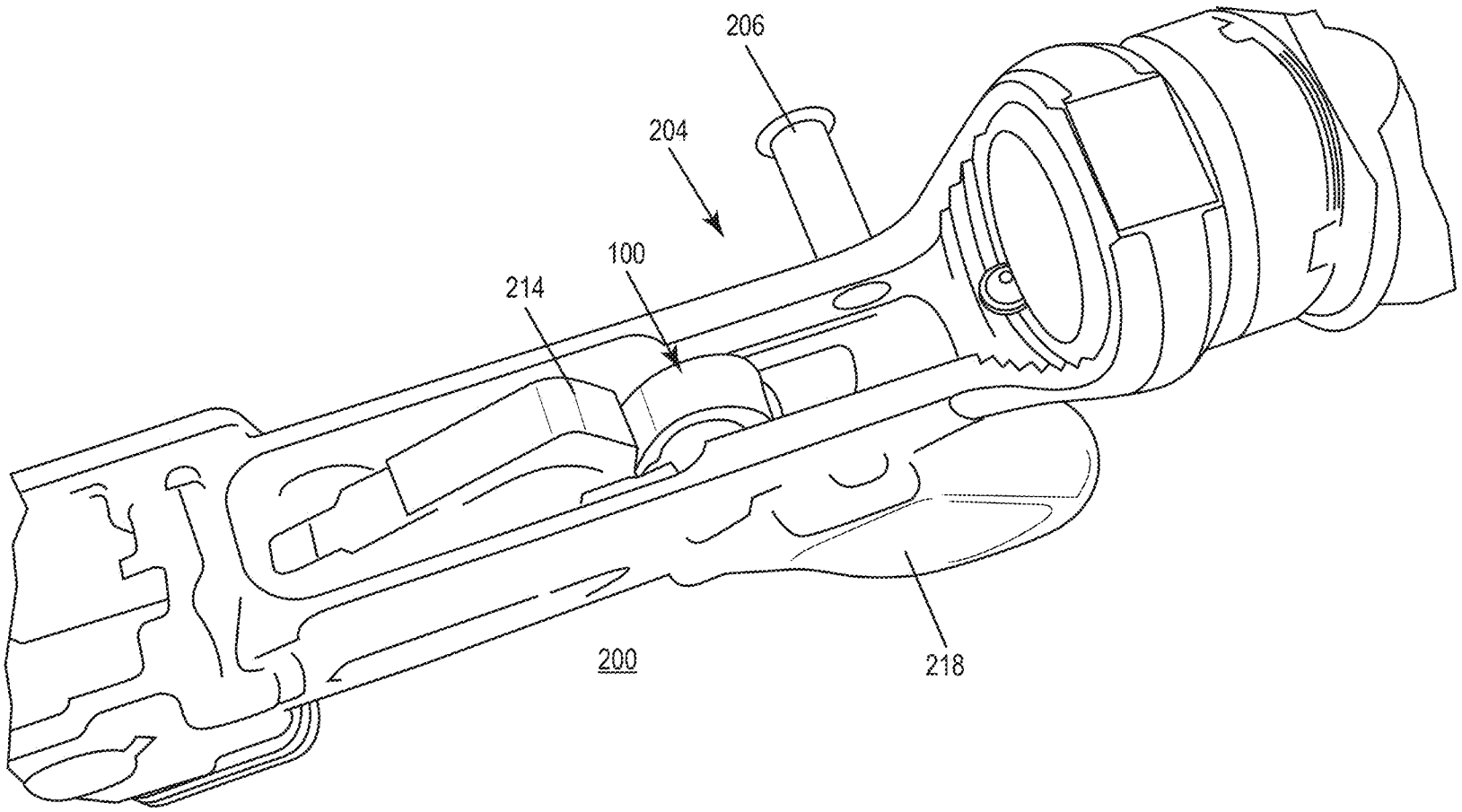

Referring to FIG. 3, selected steps for securing the firearm 200 by mating the clip 100 with the firearm 200 to place the firearm in a safety-locked position are shown. As shown in FIG. 3A, the internal housing 204 of the firearm 200 is exposed such that the trigger assembly is accessible from above. This may be done using the takedown pin 206 to separate the upper receiver 207 of the firearm 200 (not shown in FIG. 3) from the lower receiver 202 of the firearm 200. Initially, the firearm 200 is placed the safety-on position. As shown in FIG. 3B, a section of the clip 100 that extends to the first end 104 is inserted into the gap of the firearm 200 behind the safety selector rod 220. Simultaneously or subsequently, the installer of the clip 100 elastically compresses the clip 100 about the bend 102. The clip 100 is retained in a compressed state while moving the section of the clip 100 that extends to the second end 106 downward past the hammer 214 of the firearm 200. The clip 100 is then released after moving the clip 100 downward such that the clip 100 presses against the hammer 214 of the firearm 200, as shown in FIG. 3C. As a result, the firearm 200 is secured in the safety-locked position.

After the firearm 200 is secured in the safety-locked position, the internal housing 204 can be enclosed by arranging the upper receiver 207 over the lower receiver 202 and locking it in place using the takedown pin 206. Advantageously, this conceals the clip 100. To a party that comes into possession of the weapon and is unaware of the installation of the clip 100, the firearm 200 is maintained in the safety-on position and cannot be fired. The conspicuous installation of the clip means that this party will not be able easily understand why the firearm 200 is locked in the safety-on position. Thus, the installed clip 100 presents a barrier that prevents the possessor from quickly firing the weapon. Meanwhile, to possessor of the weapon that is aware of the presence of the clip 100, the clip 100 can easily and quickly removed by opening the internal housing 204 via the takedown pin 206 and pulling the clip 100. Due to the elasticity of the clip 100, it will easily deform and slide out when pulled upward by ordinary manual force. An owner familiar with the weapon can perform the removal procedure of the clip 100 in the dark. The clip 100 can be colored black or another dark color so as to create a form of camouflage that makes difficult to identify, even when the internal housing 204 is exposed. Alternatively, the clip 100 can be colored with a high contrast and/or conspicuous color, such as a fluorescent color, to potentially make it easily recognizable in the dark.

The design of the clip 100 design specifically shown in the figures and discussed herein is compatible with AR-15 style firearms. Among the broad class of AR-15 style firearms, there may be slight variations in the dimensioning and positioning and parts, including the shape and position of the hammer 214, the position of the gap behind the safety selector rod 220, and the distance between the two. Notwithstanding these variations, the depicted clip 100 design is advantageously compatible with many, if not all, of the AR-15 style variants currently sold. Due to the significant compressibility and flexibility of the clip 100, and differences in separation distance and/or arrangement of the hammer 214 can be accommodated by the clip 100. In particular, the dimensions of the clip 100 can be selected such that the clip 100 is compressed across the complete range of possible dimensional variations within the class of AR-15 style firearms.

More generally, a clip may depart from design of the clip 100 design specifically shown in the figures to make the clip compatible with a variety of different firearms, while using the concept of blocking the safety mechanism with one end of the clip and using another end of the clip to retain the clip against an opposing surface of the firearm as disclosed herein. In one particular example, a similar type of clip may be designed to be compatible with a so-called M-4 or M-16 platform. These weapons are similar to the AR-15 but are designed for military use and have fully automatic capability. The particular geometry of the trigger assembly differs in these weapons. A clip may be designed to be compatible with this weapon platform and use any opposing surface of the firearm as a surface to which the clip may be secured against. More generally, the clip concept described herein may be used with any firearm 200 that includes an accessible safety selector rod and an opposing surface from which the clip can be secured against. The safety selector rod can be any rotating mechanism that selectively blocks or prohibits movement of a trigger. The safety selector rod is accessible when the firearm can be disassembled in such a way that a gap that permits rotation of the safety selector rod is accessible. The opposing surface from which the clip can be secured against can be any surface that is able to apply counteracting force in response to the compressive force of the clip and/or can be any surface that can be engaged with a clip to form a retaining force, e.g., an interlocking force. In the disclosed embodiment, the opposing surface is provided by the hammer 214 of the firearm 200. In other types of firearms, the position and orientation of the hammer may be different, and embodiments of a clip may be designed accordingly to mate with these different hammer configurations. In still other embodiments, a clip may be designed to be secured against other surfaces within a firearm. These surfaces include outer walls of a housing, the sear, other parts of the safety mechanism, and so forth.

Although the present disclosure is not so limited, the following numbered examples demonstrate one or more aspects of the disclosure.

Example 1. A firearm safety device, comprising: a clip comprising a bend between a first end and a second end, wherein the clip is configured to mate with a firearm that comprises an accessible safety selector rod, and thereby place the firearm in a safety-locked position, wherein a section of the clip that extends to the first end is configured to be inserted into a gap of the firearm adjacent the safety selector rod and thereby prevent rotation of the safety selector rod in the safety-locked position, and wherein a section of the clip that extends to the second end is configured to be retained against an opposing surface of the firearm in the safety-locked position.

Example 2. The firearm safety device of example 1, wherein the clip is elastically compressible about the bend.

Example 3. The firearm safety device of example 2, wherein the clip is completely elastically compressible about the bend such that opposite facing spans of the clip may be brought into contact with one another without breaking or deforming the clip.

Example 4. The firearm safety device of example 1, wherein the section of the clip that extends to the second end comprises a second bend that curves in an opposite direction as the bend.

Example 5. The firearm safety device of example 1, wherein an outermost part of the section of the clip that extends to the first end has a locally reduced cross-sectional area.

Example 6. The firearm safety device of example 1, wherein the clip is formed of plastic.

Example 7. The firearm safety device of example 1, wherein the firearm that the clip is configured to mate with comprises an exposable internal housing and a gap that exposes the safety selector rod of the firearm from within the exposable internal housing.

Example 8. The firearm safety device of example 7, wherein the clip is dimensioned to fit completely within the exposable internal housing in the safety-locked position.

Example 9. The firearm safety device of example 1, wherein the firearm that the clip is configured to mate with is an AR-15 style firearm.

Example 10. The firearm safety device of example 9, wherein the clip is configured to mate with the AR-15 style firearm such that the section of the clip that extends to the first end is flush against a flat surface of the safety selector rod and such that the section of the clip that extends to the first end is compressed against a hammer of the AR-15 style firearm.

Example 11. A method of securing a firearm, the method comprising: providing a firearm that comprises an accessible safety selector rod; providing a clip comprising a bend between a first end and a second end; and mating the clip with the firearm such that the firearm is in a safety-locked position, wherein the mating of the clip with the firearm comprises: inserting a section of the clip that extends to the first end into a gap of the firearm behind the safety selector rod, thereby preventing rotation of the safety selector rod; and securely retaining a section of the clip that extends to the second end against an opposing surface of the firearm.

Example 12. The method of example 11, wherein the clip is elastically compressible about the bend, and wherein the mating of the clip with the firearm comprises: elastically compressing the clip about the bend; moving the clip downward past the opposing surface of the firearm while elastically compressed; and releasing the clip after moving the clip downward such that the clip presses against the opposing surface of the firearm.

Example 13. The method of example 12, wherein the clip is completely elastically compressible about the bend such that opposite facing spans of the clip may be brought into contact with one another without breaking or deforming the clip.

Example 14. The method of example 12, wherein the opposing surface of the firearm is an outer surface of a hammer of the firearm.

Example 15. The method of example 14, wherein the outer surface of the hammer of the firearm is angled towards a rear of the firearm when the hammer is in a cocked position, and wherein the clip is configured such that section of the clip that extends to the second end is oriented substantially parallel to the outer surface of the hammer of the firearm when the clip is mated with the firearm in the safety-locked position.

Example 16. The method of example 11, wherein the firearm is an AR-15 style firearm.

Example 17. The method of example 11, wherein the safety selector rod comprises a rounded surface and a flat surface, wherein the firearm is configured such that in a safety-on position the flat surface is accessible via a gap in the firearm, and wherein mating the clip with the firearm comprises arranging the section of the clip that extends to the first end to be within the gap and flush against the flat surface of the safety selector rod.

Example 18. The method of example 11, wherein the firearm comprises an exposable internal housing and a gap that exposes the safety selector rod of the firearm from within the exposable internal housing.

Example 19. The method of example 18, wherein the method comprises: enclosing the internal housing after mating the clip with the firearm such that the firearm is in the safety-locked position and the clip is concealed within the firearm.

Example 20. The method of example 19, wherein the firearm is an AR-15 style firearm, wherein the internal housing is disposed within the lower receiver of the AR-15 style firearm, and wherein enclosing the internal housing comprises mating an upper receiver of the firearm with the lower receiver.

The terms "substantially" and "about" as used herein encompass absolute conformity with a requirement as well as minor deviation from absolute conformity with the requirement due to manufacturing process variations, assembly, and other factors that may cause a deviation from the ideal. Provided that the deviations are not significant enough to prevent the structure from being assembled in the manner described herein or from meeting the functional requirements described herein, the term "substantially" encompasses any of these deviations.

Spatially relative terms such as "under," "below," "lower," "over," "upper," "top," bottom" and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having," "containing," "including," "comprising" and the like are open-ended terms that indicate the presence of stated elements or features, but do not preclude additional elements or features. The articles "a," "an" and "the" are intended to include the plural as well as the singular, unless the context clearly indicates otherwise.

Notably, modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only and not for purposes of limitation.

The invention claimed is:

1. A firearm safety device, comprising:

a clip comprising a bend between a first end and a second end, wherein the clip is configured to mate with an AR-15 style firearm that comprises an accessible safety selector rod, and thereby place the firearm in a safety-locked position, wherein a section of the clip that extends to the first end is configured to be inserted into a gap of the AR-15 style firearm adjacent to the safety selector rod and thereby prevent internal rotation of the safety selector rod in the safety-locked position, and wherein a section of the clip that extends to the second end is configured to be retained against an opposing surface of the AR-15 style firearm in the safety-locked position, wherein the clip is configured to be internally contained within a lower receiver of the AR-15 style firearm.

2. The firearm safety device of claim 1, wherein the clip is elastically compressible about the bend.

3. The firearm safety device of claim 2, wherein the clip is completely elastically compressible about the bend such that opposite facing spans of the clip may be brought into contact with one another without breaking or deforming the clip.

4. The firearm safety device of claim 1, wherein the section of the clip that extends to the second end comprises a second bend that curves in an opposite direction as the bend.

5. The firearm safety device of claim 1, wherein an outermost part of the section of the clip that extends to the first end has a locally reduced cross-sectional area.

6. The firearm safety device of claim 1, wherein the clip is formed of plastic.

7. The firearm safety device of claim 1, wherein the clip is configured to mate with the AR-15 style firearm such that the section of the clip that extends to the second end is compressed against a hammer of the AR-15 style firearm.

8. The method of claim 1, wherein the method comprises:

enclosing an internal housing of the firearm after mating the clip with the firearm such that the firearm is in the safety-locked position and the clip is concealed within the firearm.

9. The method of claim 8, wherein the firearm is an AR-15 style firearm, wherein the internal housing is disposed within the lower receiver of the AR-15 style firearm, and wherein enclosing the internal housing comprises mating an upper receiver of the firearm with the lower receiver.

10. The firearm safety device of claim 1, wherein the clip is configured to mate with the AR-15 style firearm such that the section of the clip that extends to the first end is flush against a flat surface of the safety selector rod.

11. A method of securing a firearm, the method comprising:

providing a firearm that comprises an accessible safety selector rod;

providing a clip comprising a bend between a first end and a second end; and mating the clip with the firearm such that the firearm is in a safety-locked position, wherein the mating of the clip with the firearm comprises:

inserting a section of the clip that extends to the first end into a gap of the firearm that is internal to a lower receiver of the firearm behind the safety selector rod, thereby preventing internal rotation of the safety selector rod; and securely retaining a section of the clip that extends to the second end against an opposing surface of the firearm.

12. The method of claim 11, wherein the clip is elastically compressible about the bend, and wherein the mating of the clip with the firearm comprises:

elastically compressing the clip about the bend;

moving the clip downward past the opposing surface of the firearm while elastically compressed; and releasing the clip after moving the clip downward such that the clip presses against the opposing surface of the firearm.

13. The method of claim 12, wherein the clip is completely elastically compressible about the bend such that opposite facing spans of the clip may be brought into contact with one another without breaking or deforming the clip.

14. The method of claim 12, wherein the opposing surface of the firearm is an outer surface of a hammer of the firearm.

15. The method of claim 14, wherein the outer surface of the hammer of the firearm is angled towards a rear of the firearm when the hammer is in a cocked position, and wherein the clip is configured such that section of the clip that extends to the second end is oriented substantially parallel to the outer surface of the hammer of the firearm when the clip is mated with the firearm in the safety-locked position.

16. The method of claim 11, wherein the firearm is an AR-15 style firearm.

17. The method of claim 11, wherein the safety selector rod comprises a rounded surface and a flat surface, wherein the firearm is configured such that in a safety-on position the flat surface is accessible via a gap in the firearm, and wherein mating the clip with the firearm comprises arranging the section of the clip that extends to the first end to be within the gap and flush against the flat surface of the safety selector rod.

* * * * *